US009273859B2

(12) United States Patent
Smith

(10) Patent No.: US 9,273,859 B2
(45) Date of Patent: Mar. 1, 2016

(54) ENCLOSURE LIGHTING SYSTEM

(71) Applicant: Robert W. Smith, Covington, GA (US)

(72) Inventor: Robert W. Smith, Covington, GA (US)

( * ) Notice: Subject to any disclaimer, the term of this patent is extended or adjusted under 35 U.S.C. 154(b) by 65 days.

(21) Appl. No.: 14/276,883

(22) Filed: May 13, 2014

(65) Prior Publication Data

US 2014/0334139 A1 Nov. 13, 2014

Related U.S. Application Data

(60) Provisional application No. 61/822,476, filed on May 13, 2013.

(51) Int. Cl.

| | |
|---|---|
| ***F21V 33/00*** | (2006.01) |
| ***F21V 23/04*** | (2006.01) |
| ***F21S 9/02*** | (2006.01) |
| ***F21K 99/00*** | (2010.01) |
| ***A47B 97/00*** | (2006.01) |
| *F21Y 101/02* | (2006.01) |
| *F21Y 103/00* | (2006.01) |

(52) U.S. Cl.

CPC ..... *F21V 23/04* (2013.01); *A47B 97/00* (2013.01); *F21K 9/30* (2013.01); *F21S 9/02* (2013.01); *F21V 33/0016* (2013.01); *A47B 2220/0077* (2013.01); *F21Y 2101/02* (2013.01); *F21Y 2103/003* (2013.01)

(58) Field of Classification Search

CPC .. A47B 97/00; A47B 2220/0077; F21K 9/00; F21S 9/02; F21V 23/04; F21V 33/0016; F21Y 2101/02; F21Y 2103/003

USPC ..... 362/191

See application file for complete search history.

(56) References Cited

U.S. PATENT DOCUMENTS 4,872,095 A * 10/1989 Dubak ..... F21V 33/0016 362/100

5,226,724 A * 7/1993 Kanarek ..... F21S 2/00 362/151

5,797,672 A * 8/1998 Dobert ..... B60Q 1/2615 362/190

2008/0266856 A1* 10/2008 Chien ..... H04N 7/181 362/249.01

* cited by examiner

*Primary Examiner* — Sharon Payne

(74) *Attorney, Agent, or Firm* — Bryan W. Bockhop; Bockhop & Associates, LLC

(57) ABSTRACT

The present invention provides a lighting system for lighting the interior of an enclosure. The enclosure has at least one movable door or drawer for opening and accessing the interior of the enclosure. The lighting system includes a light assembly with a lower casing and an upper casing. The light assembly also includes a plurality of light emitting diode (LED) mounted within the upper casing, at least one battery mounted within the upper casing, electrical circuitry connecting the plurality of LED's to the battery, a means for mounting the lower casing to a surface, and a electrical receptacle mounted within the lower casing. The lighting system further includes a magnetic switch including an electrical cable or harness. The cable has an electrical plug configured to electrically mate with the receptacle of the lower casing. The magnetic switch has a means for mounting to an interior enclosure surface. The electrical cable or harness allows mounting of the magnetic switch at a location within the enclosure away from the light assembly. The lighting system further includes a magnet having a means for mounting the magnet to the enclosure door. The magnet is positioned in proximity to the magnetic switch when the enclosure door is in a closed position. Upon installation of the lighting system, the plug of the magnetic switch is mated with the electrical receptacle of the lower casing. The battery, magnetic switch, circuitry, and the LED are arranged, mounted, and electrically interconnected within the enclosure. When the enclosure door is opened, the magnet is removed from proximity to magnetic switch, the circuitry connects power from the battery to the plurality of LED's, and the LED's light the enclosure interior.

19 Claims, 8 Drawing Sheets

ENCLOSURE LIGHTING SYSTEM

CROSS-REFERENCE TO RELATED APPLICATION

This application claims the benefit of U.S. Provisional Application Ser. No. 61/822,476, filed on May 13, 2013.

BACKGROUND OF THE INVENTION

1. Field of the Invention

The present invention generally relates to apparatuses and systems for use in enclosure lighting. More particularly, the present invention relates to a battery powered apparatus and system for aftermarket and retro-fit use as enclosure lighting.

2. Description of the Related Art

The modern home, garage, and office environment has many enclosures in the form of cabinets, draws, toolboxes and furniture. The enclosures are often dark and poorly lighted. The location of the enclosure within the home, garage, or office determines the available ambient lighting conditions, and the available lighting is often inadequate to view the enclosure contents. To date there is little prior art designed to conveniently aid in lighting the contents of an existing cabinet, whether the limited visibility is due to poor room lighting, no lighting, or deep shelving units. Thus, there is a need for a lighting system to be easily added within a variety of enclosure types by an unskilled homeowner or office worker so that the contents are readily viewed and accessible when the cabinet is opened.

Prior art solutions to cabinet lighting are often built into the cabinet and require AC power and the associated requirement of a receptacle close to the enclosure. In every home or office, many enclosure exist which do not have built in lighting. Aftermarket lighting systems are often complex to install and still require an AC power source. The light intensity required to light a simple cabinet is low. The AC powered systems of the prior art are often overkill to the lighting requirements in a dark kitchen cabinet.

In adding an aftermarket light source to an existing cabinet or other enclosure, the homeowner or office worker is faced with installation. Many prior art lighting systems use a push button or toggle switch to enable the light when the cabinet door is opened. The switches are often fussy on mounting location and operating tolerances and their installation is often outside the skill level of the homeowner or office worker. In prior art systems designed for easy installation, the switch for sensing the door position is often integral with the housing containing the light source. This all-in-one design makes positioning the unit within the cabinet complicated, and the unit often interferes with the utility of the enclosure as a storage space. The all-in-one prior art designs require the light source be placed at a non-optimum location for lighting the enclosure interior, i.e. beside the enclosure door. Moreover, many cabinets have more than one door, and the prior art systems only illuminate the cabinet interior when the switched door is opened. The door designs of various enclosures offer an additional challenge to prior art switch installations. For example, modern cabinets use full overlay, partial overlay and recessed doors. The switch installation must be customized for each type of door and enclosure shape. The prior art switch installation often requires cutting, drilling, or other modifications of the enclosure structure and door.

Some prior art systems have used complex infa-red, or other wireless connection, with signals and circuitry to connect the door sensing switch to the light unit. These units are overly complex for the task at hand and their price point is often a deterrent to use in a simple cabinet with poor lighting.

According, it would be advantageous to provide a lighting system for installation in a variety of enclosure types which does not require AC power. The system should be affordable and allow retro-fit into existing cabinetry or other enclosures. The system installation should be readily within the skills of a homeowner or office worker. The system should allow the placement of the light source at the optimum location within the enclosure. The system should provide for simple installation of a switch to sense the opening and closing of the enclosure door, and activate the light when the door is open. Enclosures having multiple doors should be easily accommodated and the system should operate when any one of the doors is opened. It is thus to such an enclosure lighting system that the present invention is primarily directed.

SUMMARY OF THE INVENTION

The disadvantages of the prior art are overcome by the present invention which, in one aspect, is a lighting system for lighting the interior of an enclosure. The enclosure has at least one door configured for opening and accessing the interior of the enclosure. The lighting system includes a light assembly with a lower casing and an upper casing. The light assembly also includes at least one light emitting diode (LED) mounted within the upper casing, at least one battery mounted within the upper casing, electrical circuitry connecting the at least one LED to the at least one battery, a means for mounting the lower casing to a surface, and at least one electrical receptacle mounted within the lower casing. The receptacle of the light assembly is in electrical interconnection with the circuitry.

The lighting system further includes at least one magnetic switch including an electrical cable or harness. The cable has an electrical plug configured to electrically mate with the at least one receptacle of the lower casing. The magnetic switch has a means for mounting to an interior enclosure surface. The electrical cable or harness allows mounting of the magnetic switch at a location within the enclosure away from the light assembly.

The lighting system further includes at least one magnet having a means for mounting the magnet to the enclosure door. The magnet is positioned in proximity to the magnetic switch when the enclosure door is in a closed position.

Upon installation of the lighting system, the plug of the at least one magnetic switch is mated with the at least one electrical receptacle of the lower casing. The at least one battery, at least one magnetic switch, circuitry, and the at least one LED are arranged, mounted, and electrically interconnected within the enclosure. When the enclosure door is opened, the at least one magnet is removed from proximity to the at least one magnetic switch, the circuitry connects power from the at least one battery to the at least one LED, and the at least one LED lights the enclosure interior.

In another aspect of the present invention, a manual switch is interposed in the circuitry. The switch has a first position and a second position. When the manual switch is in the first position, the circuitry will connect power from the at least one battery to the at least one LED. When the manual switch is in the second position, the circuitry will not connect power from the at least one battery to the at least one LED.

In yet another aspect of the invention, the mounting means of the lower casing, magnetic strip, and magnet is by at least one of: an adhesive strip, an adhesive, a hook and loop fastener, a mechanical fastener.

In yet another aspect of the invention, a plurality of magnetic switches are mounted to the interior enclosure surfaces, and a complimentary plurality of magnets are mounted to a plurality of doors of the enclosure. When at least one of the enclosure doors is opened, the at least one LED lights. And the at least one battery is replaceable.

In yet another aspect of the invention, the upper casing may be readily disengaged from the lower casing and removed from the enclosure to allow battery replacement. The upper casing slideably engages the lower casing by means of a plurality of protrusions in the lower casing engaging with a plurality of channels within the upper casing. In another aspect, the upper casing slideably engages the lower casing by means of a plurality of protrusions in the upper casing engaging with a plurality of channels within the lower casing. The upper casing can also engage the lower casing by means of at least one plastic snap. The upper casing may also be retained in contact with the lower casing by magnetic force.

In yet another aspect of the invention, the at least one battery is not replaceable. The light assembly has multiple LEDs. And the electrical cable of the at least one magnetic switch is between 6 inches and 36 inches in length.

In yet another aspect of the present invention is a lighting system for lighting the interior of an enclosure. The enclosure has at least one door configured for opening and accessing the interior of the enclosure. The lighting system includes a light assembly with a lower casing and an upper casing. The light assembly also includes at least one light emitting diode (LED) mounted within the upper casing, at least one battery mounted within the upper casing, electrical circuitry connecting the at least one LED to the at least one battery, a means for mounting the lower casing to a surface, and at least one electrical receptacle mounted within the lower casing. The receptacle of the light assembly is in electrical interconnection with the circuitry.

The lighting system further includes at least one magnetic switch including an electrical cable or harness. The cable has an electrical plug configured to electrically mate with the at least one receptacle of the lower casing. The magnetic switch has a means for mounting to an interior enclosure surface. The electrical cable or harness allows mounting of the magnetic switch at a location within the enclosure away from the light assembly.

The lighting system further includes at least one magnet having a means for mounting the magnet to the enclosure door. The magnet is positioned in proximity to the magnetic switch when the enclosure door is in a closed position. The upper casing slideably engages the lower casing by means of a plurality of protrusions in the lower casing engaging with a plurality of channels within the upper casing. The upper casing may be readily disengaged from the lower casing and removed from the enclosure to allow battery replacement.

Upon installation of the lighting system, the plug of the at least one magnetic switch is mated with the at least one electrical receptacle of the lower casing. The at least one battery, at least one magnetic switch, circuitry, and the at least one LED are arranged, mounted, and electrically interconnected within the enclosure. When the enclosure door is opened, the at least one magnet is removed from proximity to the at least one magnetic switch, the circuitry connects power from the at least one battery to the at least one LED, and the at least one LED lights the enclosure interior.

In yet another aspect of the present invention, the upper casing slideably engages the lower casing by means of a protrusion in the upper casing engaging a channel within the lower casing. The upper casing may engage the lower casing by means of at least one plastic snap. The upper casing may be retained in contact with the lower casing by magnetic force.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

The lighting system of the present invention provides a way to light the interior of existing enclosures in the home or office environments. The lighting system may be readily installed and configured within any enclosure requiring additional lighting within the interior space. The lighting system is easily configured within the enclosure with the light assembly positioned upon a convenient interior surface. A magnetic switch is installed on an enclosure interior surface adjacent to the access door. A magnet is positioned upon the access door within a proximity to the magnetic switch, and operates the magnetic switch upon opening or closing the door. An electrical cable connects the magnetic switch with the light assembly and allows the placement of the light assembly in the most advantageous spot within the cabinetry.

As used herein, the term "enclosure" refers to any interior space which can benefit from interior lighting and is separated by a door or drawer front from access by a user. The lighting system of the present invention may be used with various enclosures, such as cabinets, drawers, furniture, closets, interior doors, entry doors, and the like.

Figure 1:
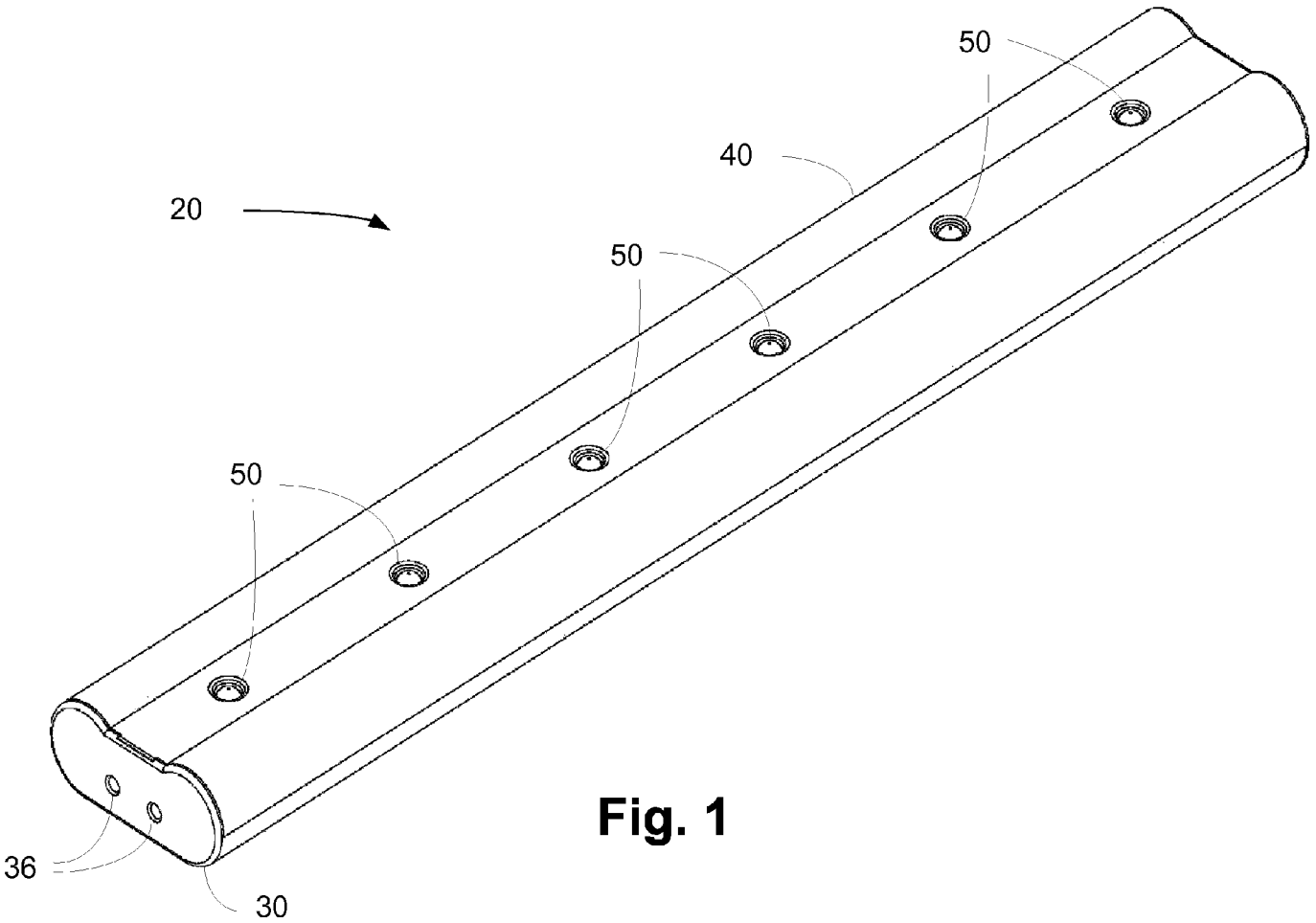
FIG. 1 is a side-perspective view of the light assembly.

In a first embodiment of the present invention, as depicted in FIG. 1, the light assembly has a lower casing 30 and an upper casing 40. The lower casing 30 may be readily affixed to an interior surface of the enclosure using double sided adhesive tape. Light Emitting Diodes (LED's) 50 are positioned within the upper casing 40. Electrical receptacles 48 are positioned within the lower casing 30.

Figure 2:
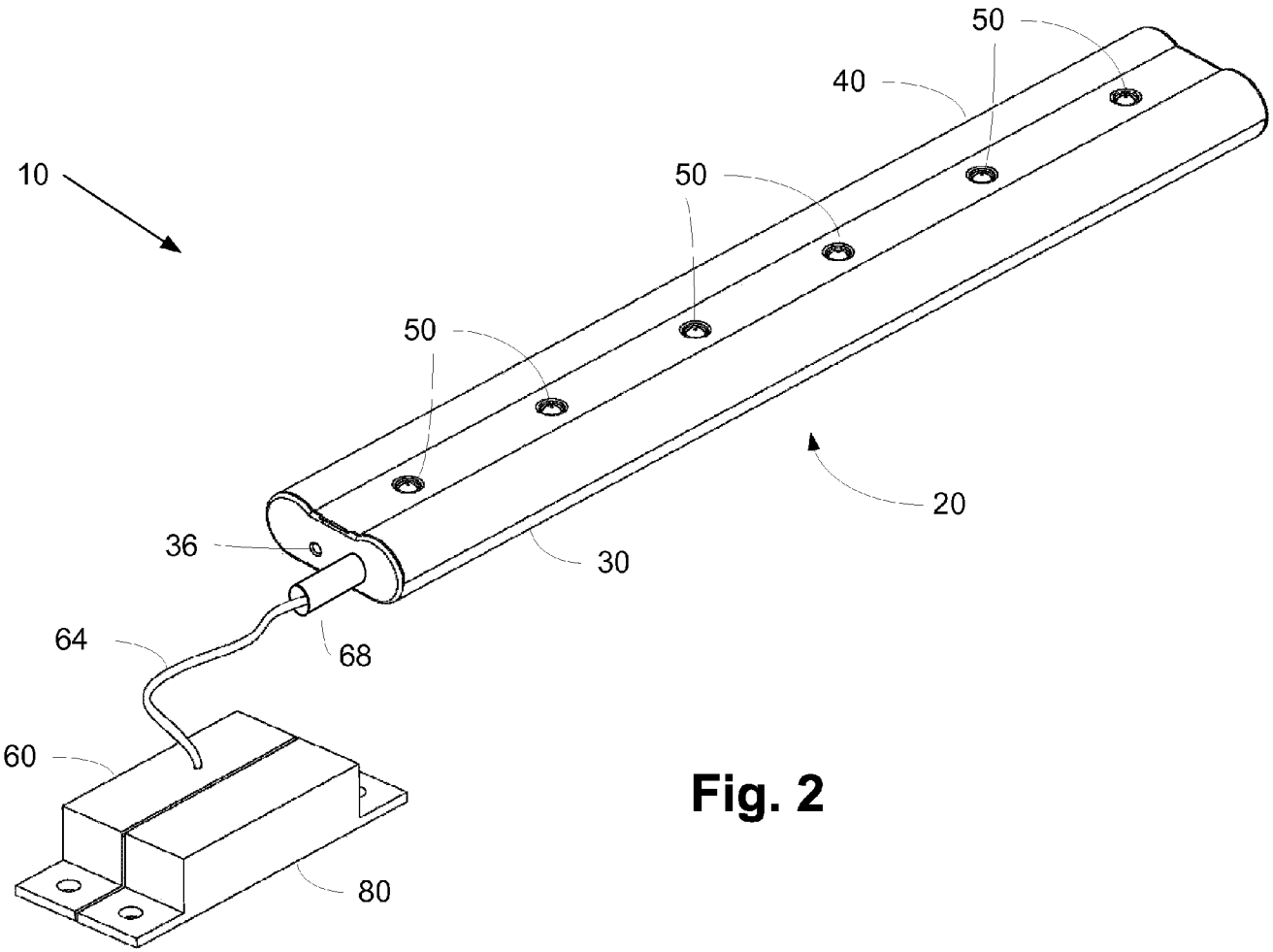
FIG. 2 is a side-perspective view of the enclosure lighting system.

As depicted in FIG. 2, the lighting system 10 includes the light assembly 20. A magnetic switch 60 is in electrical connection with the light assembly 20 via an electrical cable 64. An electrical plug 68 on the end of the cable 64 engages with a receptacle 48 positioned within the lower casing 30. A magnet 80 is positioned adjacent the magnetic switch 60 and may operate the magnetic switch when brought into proximity of the magnetic switch. The magnetic switch is normally open, and closes in the presence of the magnetic field of the magnet. The ground wire of the light assembly is run through the magnetic switch, and upon closure of the switch, the light illuminates.

Figure 3:
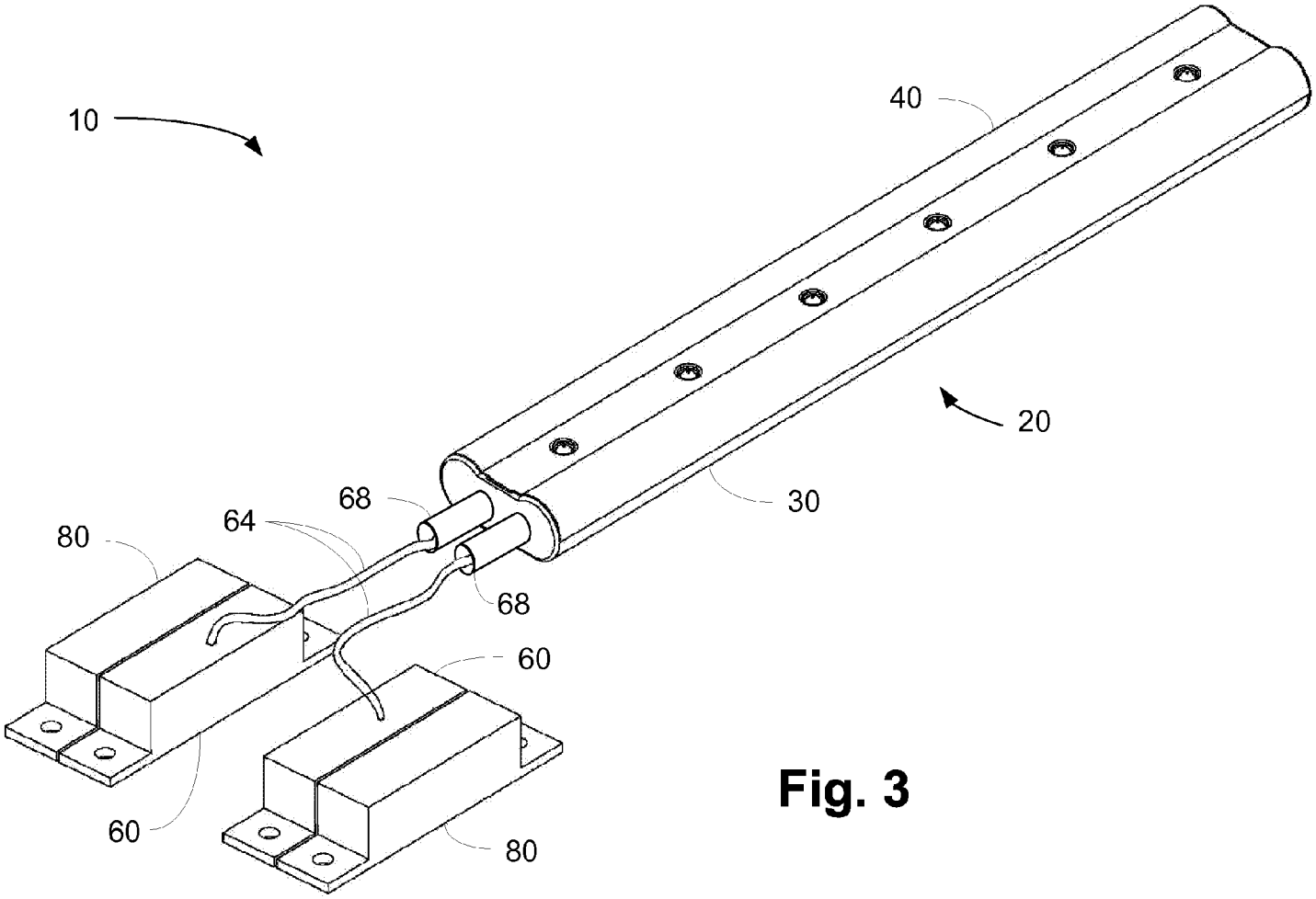
FIG. 3 is a side-perspective view of the enclosure lighting system with dual magnetic switches.

As depicted in FIG. 3, the lighting system 10 may include a plurality of magnetic switches 60 and magnets 80. A magnet is mounted to each door of the cabinet. Using the multiple magnetic switches and magnets, the lighting system illuminates cabinets with multiple doors when any one of the cabinet doors is opened. A plurality of electrical receptacles 36 are provided within the lower casing 30 of the light assembly 20. An electrical plug 68 at the end of each cable 64 is configured to engage a corresponding receptacle 36 in the lower casing 30. The electrical cables 64 may be between 6 inches and 36 inches in length. The cables readily allow placement of the light assembly at the optimum location within the enclosure. The electrical plug 68 and cable 64 may pass around obstacles within the enclosure, and may pass between shelves or partitions within the enclosure and the enclosure side and back walls, with no modifications to the enclosure components required. The magnetic switch 60 is supplied to the user with the cable 64 attached. In an alternative embodiment, the cable 64 may be interconnected with the magnetic switch by an electrical connector.

Figure 4:
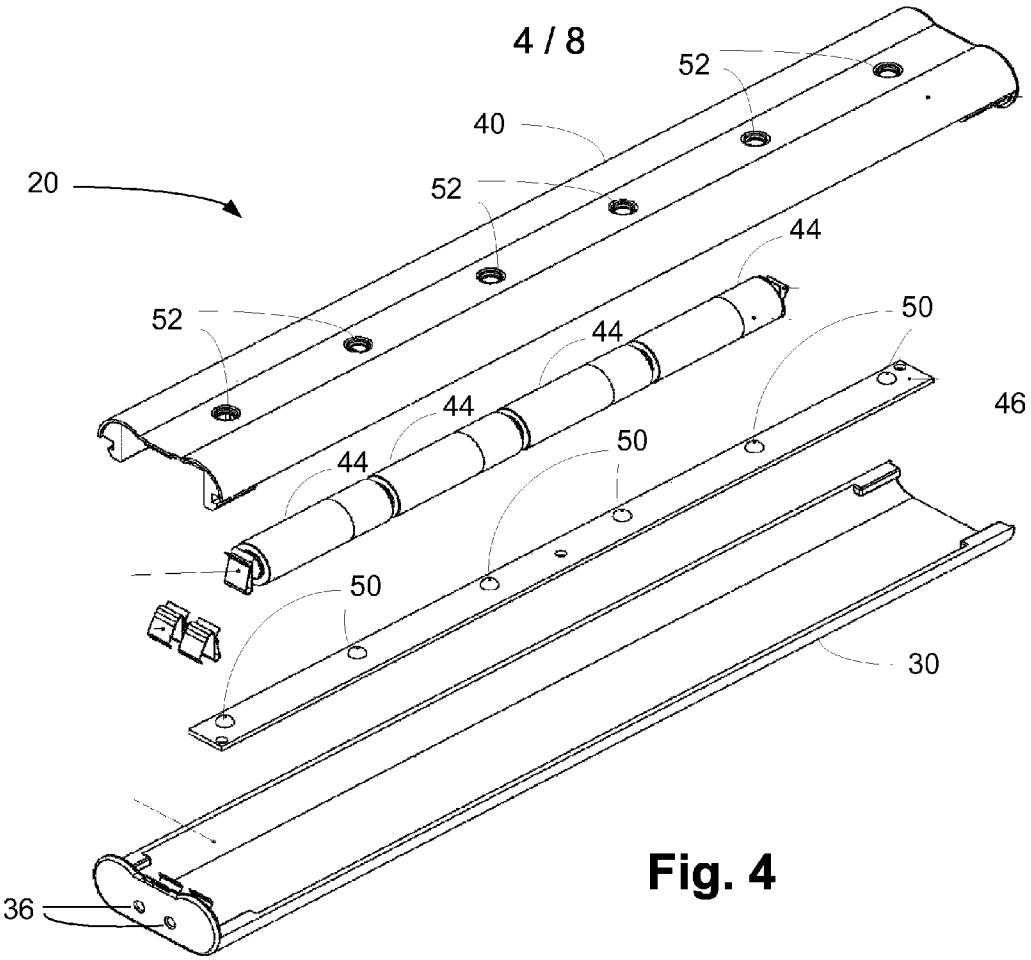
FIG. 4 is an exploded view of the components of the light assembly.

As depicted in FIG. 4, the light assembly 20 comprises a lower casing 30 and an upper casing 40. The lower casing 30 has electrical receptacles 36 affixed therein. The upper casing 40 retains and houses the electronic circuitry 46 and a plurality of LED's 50 mounted to the circuit board. Openings 52 within the upper casing receive the LED body within and allow the light produced by the LED's to illuminate the cabinet. The upper casing 40 also retains and houses a plurality of batteries 44 for powering the light assembly.

In another embodiment of the present invention, the light assembly 20 has six (6) LED's 50 and is powered by four (4) AA size DC batteries. The LED's produce a white light, are 5 mm in size, flat top, and are rated at 30 milliampere ("mA") of current. The six parallel LED's have 100 Ohm, current limiting resistors, drawing a total of 130 mA of current. The LED's produce a combined luminous intensity of over 100, 000 millicandela ("mcd") in total, and are capable of lighting even a large volume enclosure. The batteries are capable of operating the LED's for approximately 36 hours of operation. In a typical home or office environment, the 36 hours of operation will mean years of normal use when accessing the enclosure. As may be appreciated by those skilled in the art, in alternative embodiments of the present invention, other sizes of battery cells and quantities of batteries may be readily configured within the light assembly. As may be further appreciated by those skilled in the art, other quantities and arrangements of the LED's are possible within the light assembly. In another alternative embodiment, the light assembly may be powered by rechargeable batteries. The upper casing 40 of the light assembly may be periodically removed and brought into electrical connection with a charging unit to recharge the batteries. In yet another alternative embodiment of the present invention, a power on and off switch is incorporated into the light assembly to allow the system to shut off. In yet another alternative embodiment, a timing circuit is incorporated into the lighting system to shut off the system after a given period of lighting, for example after 5 minutes of operation.

Figure 5A:
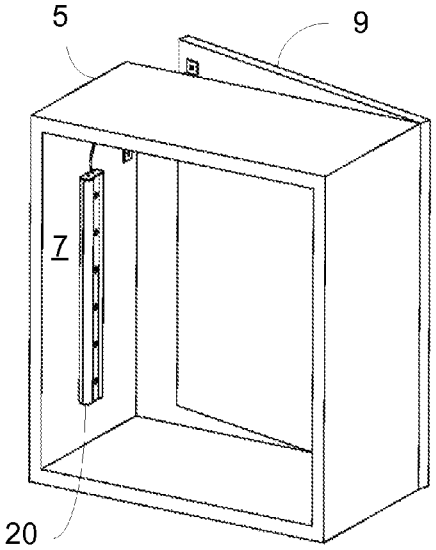
FIGS. 5A-5D are perspective views of the enclosure lighting system installed within a cabinet.
Figure 5B:
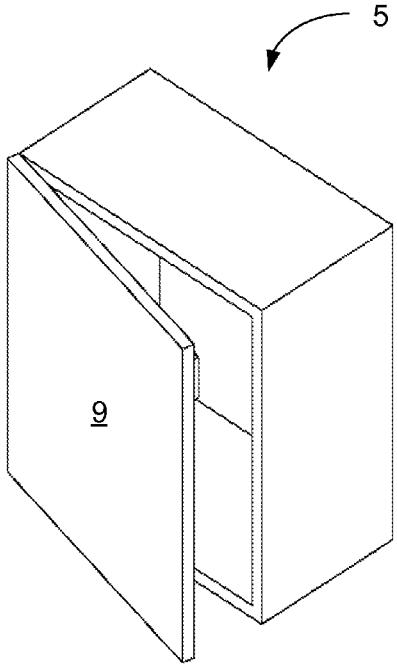
Figure 5C:
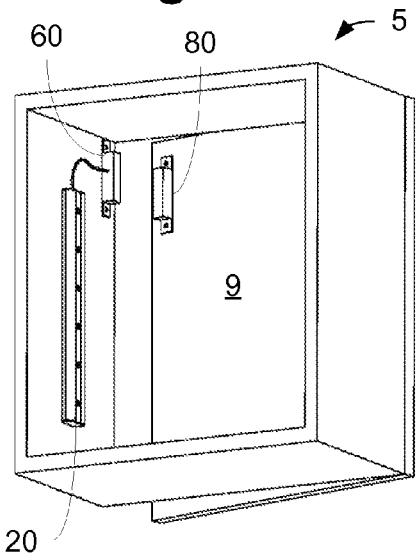
Figure 5D:
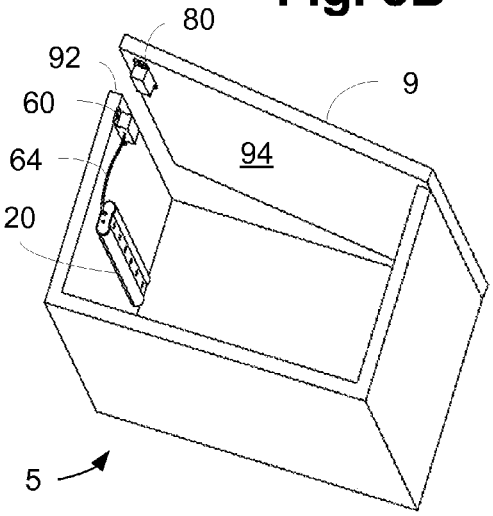

The enclosure lighting system of the present invention as applied to a common cabinet assembly 5 with a single door 9 is depicted in FIGS. 5A-5D. FIG. 5A depicts the cabinet assembly from the rear with the back wall of the cabinet removed. The light assembly 20 is positioned within the cabinet 5 adjacent the cabinet internal sidewall 7. As depicted in FIG. 5B, the cabinet assembly 5 has a single full overlay cabinet door. As depicted in FIG. 5C, the cable 64 allows the magnetic switch 60 to be positioned and mounted in any convenient location within the door opening, and in a location offering minimum intrusion into the utility of the cabinet. The magnet 80 is positioned and mounted upon the interior surface of the door 9. The magnetic coupling between the magnetic switch 60 and magnet 80 requires only proximity of the two units 60, 80 when the door is closed and does not require any precise alignment. The magnetic switch will reliably operate when the magnet is within a one (1) inch proximity of the switch. In many enclosures with imperfect door closure and alignment, the magnetic coupling between the two units 60, 80 provides a simple means to achieve the light actuation by the door. The magnet 80 may approach the magnetic switch 60 from any angle, and from the front or any side of the magnetic switch. The ability to mount the magnet 80 in any orientation relative to the magnetic switch 60 provides for installation flexibility in a variety of enclosures, such as cabinet designs with full overlay, partial overlay, or recessed doors, and for various drawer configurations. The only requirement to operate the lighting system is relative movement between the magnet 80 and magnetic switch 60 upon accessing the enclosure. As depicted in FIG. 5D, in this mounting embodiment the magnetic switch 60 is set-back from the cabinet face surface 92. The magnet 80 is positioned and mounted upon the door 9 interior surface 94 and approaches the magnetic switch as the door is closed. Precise alignment of the magnet and magnetic switch is not required, only proximity.

In another embodiment of the present invention, the components of the enclosure lighting system, specifically the lower casing 30, the magnetic switch 60, and the magnets 80, may be affixed to the enclosure surfaces by double sided adhesive tape. In other alternative embodiments, the enclosure lighting system components may be affixed in place by any combination of; adhesives, hook and loop fasteners, or mechanical fasteners in the form of screws, or by other fastening techniques as are known in the art. The lighting system may therefore be readily installed within an existing enclosure, such as a kitchen cabinet, with no modifications or damage to the existing enclosure assembly. The user may readily reconfigure the lighting system installation, or remove the enclosure lighting system for use in another enclosure.

The use of the magnetic switch and magnet aids and simplifies the installation of the lighting system within an existing enclosure by a Do It Yourself (DIY) homeowner or other user. A typical home or workshop provides a range of cabinet door and drawer styles and configurations. The flexible installation provided by the present invention allows the installation and use of the lighting system within the various enclosure styles. The simple requirement of proximity, but not precise alignment, of the magnetic switch and magnet allows the ready installation of the lighting system within cabinets having full overlay, partial overlay, or recessed doors. The lighting system can also be readily installed within drawers with various drawer face configurations. In all installations, the switch and magnet are placed in a location where they will not impede or interfere with the use of the enclosure. The light assembly 20 is positioned on any convenient surface within the enclosure 5 and preferably in an optimum location to illuminate the enclosure interior. The electrical cable 64 allows ready and simple interconnection between the optimum locations of the magnetic switch 60 and light assembly 20.

Figure 6A:
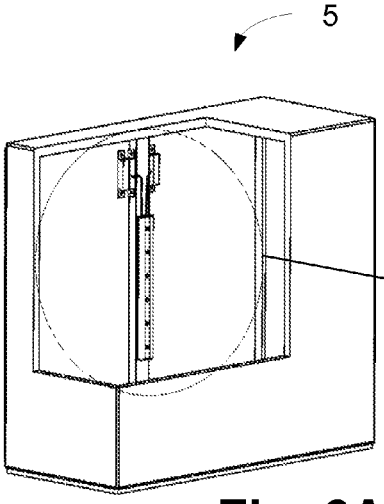
FIGS. 6A-6D are perspective views of the enclosure lighting system with dual magnetic switches installed within a two door cabinet.
Figure 6B:
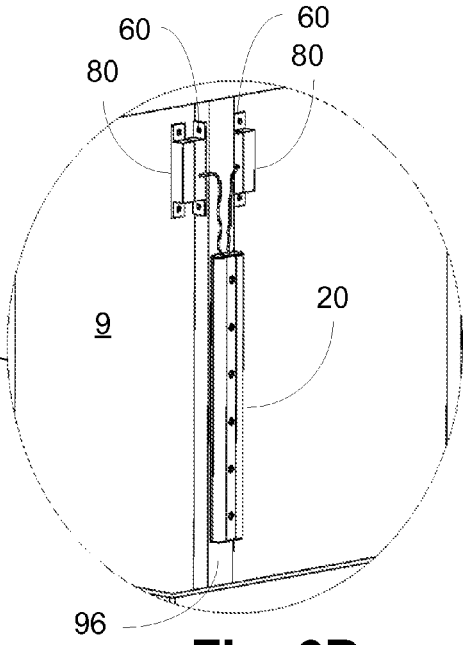
Figure 6C:
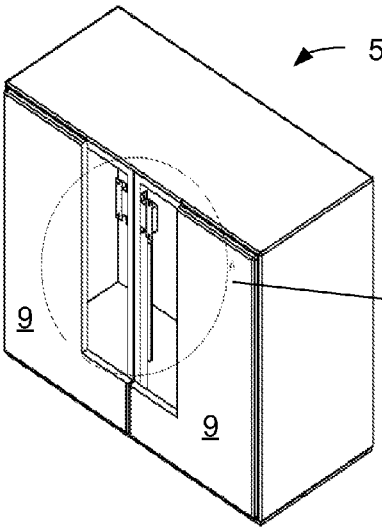
Figure 6D:
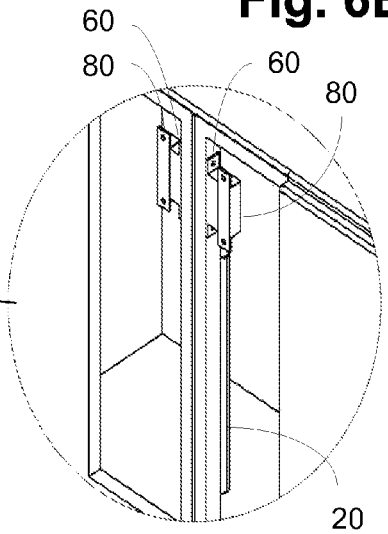

The enclosure lighting system of the present invention applied to a double door cabinet assembly 5 is depicted in FIGS. 6A-6D. FIG. 6A depicts the cabinet assembly from the rear with the back wall of the cabinet removed. The light assembly 20 is positioned within the cabinet 5 adjacent a cabinet internal surface 7. In this illustrative embodiment, the light assembly 20 is positioned vertically along the center rail 94 of the cabinet 5. In the enlarged depiction of FIG. 6B, the cabinet assembly 5 has two full overlay cabinet doors 9. Dual magnetic switches 60 are positioned upon either side of the center rail 96. In the depiction of FIG. 6C, portions of the doors 9 have been cutaway to display the lighting system 10 installation within the enclosure 5. In the enlarged depiction of FIG. 6D, dual magnets 80 are positioned upon the interior of the door surface. The magnets 80 lie adjacent to and actuate the magnetic switches 60 when the door is in the closed position. The illustrative embodiment depicted in FIGS. 6A-6D further demonstrates how the proximity magnetic coupling between the magnetic switch and magnet allows for simple alignment of the magnet adjacent to the magnetic switch body by a DIY lighting system installer.

Figure 7A:
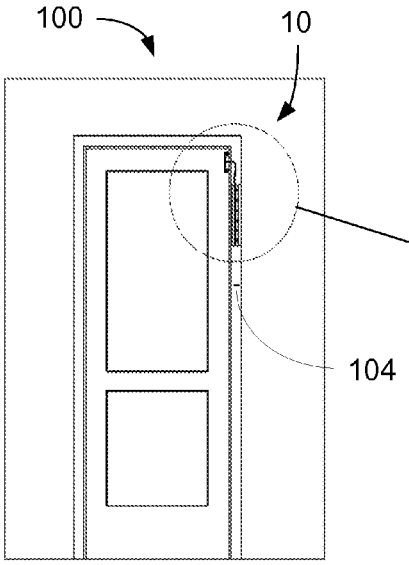
FIGS. 7A-7B are front views of the enclosure lighting system installed upon an interior door.
Figure 7B:
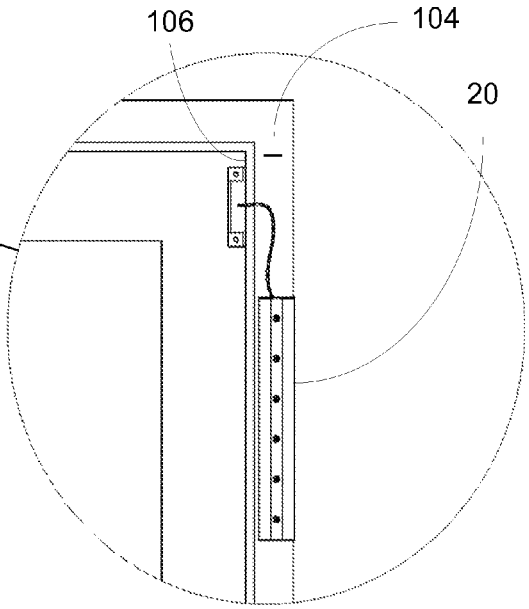
Figure 7C:
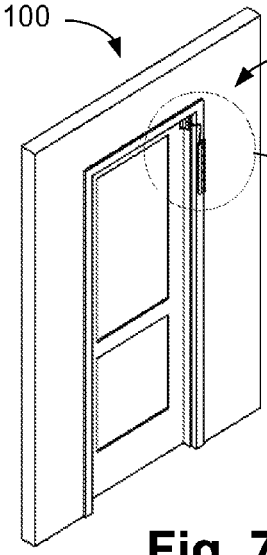
FIGS. 7C-7D are side-perspective views of the enclosure lighting system installed upon an interior door.
Figure 7D:
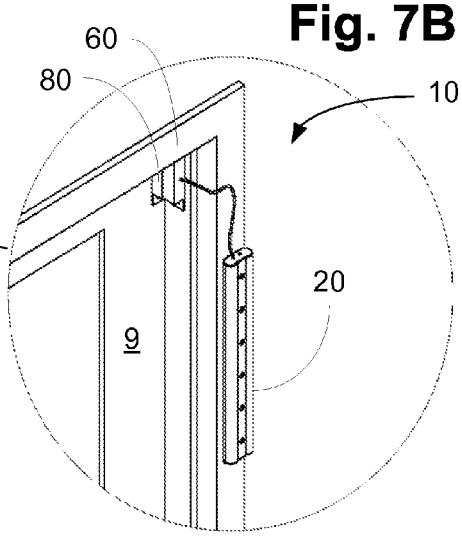

Another alternative embodiment of the present invention is depicted in FIGS. 7A-7D. In FIGS. 7A-7D, the enclosure lighting system 10 is applied to an interior or entry door as may be found within a home or office. FIG. 7A depicts the door assembly from the interior side of the door. The enclosure lighting system 10 is positioned at an upper corner of the door and opposing the hinge side of the door. In this illustrative embodiment, the light assembly 20 is positioned vertically along the upper face of the door jam 104. In this position, the light assembly will effectively cast light out into the interior space of the room. In the enlarged depiction of FIG. 7B, the light assembly 20 is positioned upon the door jam 104 high upon the jam. A magnetic switch 60 is positioned upon the interior surface 106 of the door jam. FIG. 7C is a side perspective view depicting the enclosure lighting system 10 installed upon the door assembly 100. In the enlarged side perspective depiction of FIG. 7D, a magnet 80 is positioned upon the interior face of the door. The magnet 80 again lies in proximity to and actuates the magnetic switch 60 when the door is in the closed position. The illustrative embodiment depicted in FIGS. 6A-6D further demonstrates how the proximity magnetic coupling between the magnetic switch and magnet allows for simple alignment of the magnet in proximity to the magnetic switch body by the DIY lighting system installer.

In other illustrative embodiments of the present invention, the light assembly 20 of FIGS. 7A-7D may also be positioned upon the upper header of the door, or upon an adjacent wall. In other alternative embodiments, the enclosure lighting system 10 may be positioned upon the hinge side of the door, with the lighting assembly mounted upon the door jam or an adjacent wall. The freedom of positioning of the light assembly and magnetic switch is an improvement over the prior art by the present invention.

Figures 8A, 8B, 8C:
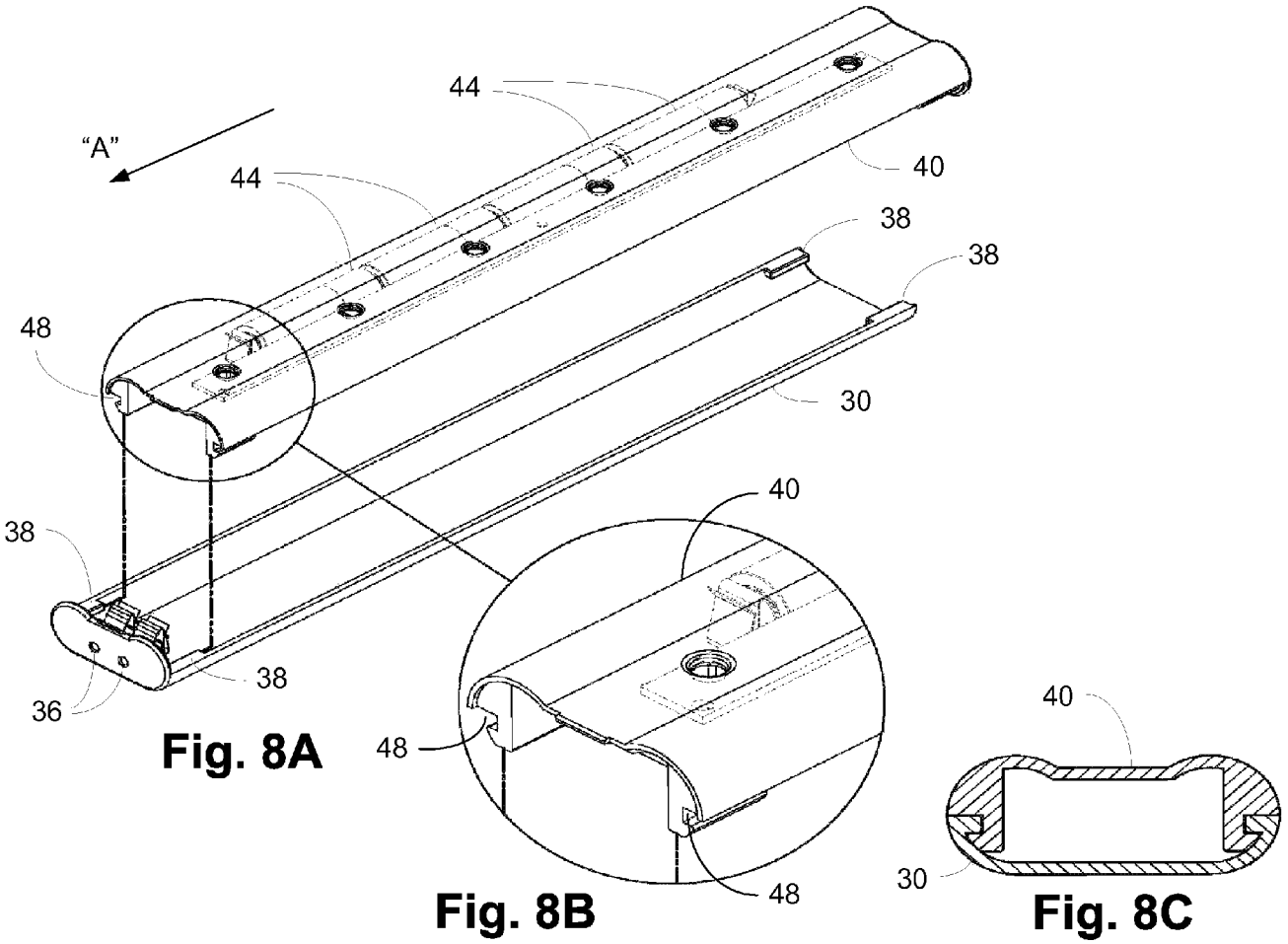
FIG. 8A a side-perspective view depicting the lower casing and upper casing halves of the light assembly de-mated.
FIG. 8B is a side-perspective view of the upper casing.
FIG. 8C is a cross-sectional view of the lower casing and upper casing mated together.

Another embodiment of the present invention is depicted in FIGS. 8A-8C. FIG. 8A depicts the upper casing 40 of the light assembly 20 de-mated from the lower casing 30. The upper casing 40 and lower casing 30 are molded from a plastic or polymer as are known by those skilled in the art. The upper casing contains the batteries 44 which power the device. As the batteries have a finite operational life, the ease with which a user may replace the batteries is important. As depicted in FIGS. 8A-8B, the upper casing 40 has channels 48 which are configured to engage protrusions 38 molded within the lower casing 30. At assembly, the upper casing 40 is positioned upon the lower casing 30 and slid in the direction of Arrow "A" to positively mate the two casing halves 30, 40 together. When case halves 30, 40 are mated together, the battery, electrical receptacle, circuitry, and LED's are electrically interconnected within the lighting assembly 20. A plastic snap is molded into the casing halves to positively retain the casings in the mated position. The upper casing 40 may be readily de-mated or disengaged from the lower casing 30 by sliding in the direction opposing Arrow "A". FIG. 8C depicts a cross-sectional view of the mated lower casing 30 and upper casing 40. As will be appreciated by those skilled in the art, the channels may be molded into the lower casing 30 and the protrusions molded into the upper casing 40 to achieve the same engagement of the casing halves. In another alternative embodiment of the present invention, the casing halves 30, 40 may retained together by magnets positioned within each casing half. The magnetic force may be easily overcome by the user to allow removal of the upper casing 40 from the installed enclosure lighting system and replacement or charging of the batteries.

In use of the enclosure lighting system of the present invention, the upper casing 40, with batteries 44, may be readily disengaged, or de-mated, from the lower casing and removed from the enclosure to allow battery replacement, or battery charging, by the user. The lower casing 30, the magnetic switches 60, and the magnets 80, all remain in place within the enclosure during battery replacement. The ability of the user to de-mate the casing halves 30, 40 allows for simple battery replacement outside the enclosure and aids in the enjoyment and utility of the enclosure lighting system.

While there has been shown a preferred embodiment of the present invention, it is to be understood that certain changes may be made in the forms and arrangement of the elements for the enclosure lighting system and apparatus without departing from the underlying spirit and scope of the invention.

What is claimed is:

1. A lighting system for lighting the interior of an enclosure, the enclosure having at least one door configured for opening and accessing an interior of the enclosure, the lighting system comprising:

a magnetic switch configured to be mounted to a portion of the enclosure that is adjacent to the door;

an electrical cable that is electrically coupled to the magnetic switch;

a magnet configured to be mounted on the door so that the magnet is in close proximity to the magnetic switch when the door is closed and wherein the magnet is not in close proximity to the magnetic switch when the door is opened; and a light assembly that is configured to be mounted in the interior of the enclosure spaced apart from the magnetic switch, the light assembly including:

at least one light emitting diode (LED);

a battery; and a circuit that is electrically coupled to the electrical cable and is in in electrical communication with the magnetic switch therethrough, wherein the circuit decouples the LED from the battery when the magnet is in close proximity to the magnetic switch and wherein the circuit couples the LED to the battery, thereby energizing the LED, when the magnet is not in close proximity to the magnetic switch.

2. The system of claim 1, further comprising a manual switch that is configured to energize the at least one LED when in a first position and to de-energize the at least one LED when in a second position.

3. The system of claim 1, further comprising a light assembly mount for mounting the light assembly to the enclosure, the light assembly mount selected from a list of mounts consisting of: an adhesive strip, an adhesive, a hook and loop fastener, and a mechanical fastener.

4. The system of claim 1, further comprising a magnetic switch mount for mounting the magnetic switch to the enclosure, the magnetic switch mount selected from a list of mounts consisting of: an adhesive strip, an adhesive, a hook and loop fastener, and a mechanical fastener.

5. The system of claim 1, further comprising a magnet mount for mounting the magnet to the enclosure, the magnet mount selected from a list of mounts consisting of: an adhesive strip, an adhesive, a hook and loop fastener, and a mechanical fastener.

6. The system of claim 1, wherein the light assembly includes and upper casing and a lower casing and where the upper casing is configured to be disengaged from the lower casing so as to facilitate replacement of the battery.

7. The system of claim 6, wherein the upper casing slideably engages the lower casing by means of a plurality of protrusions in the lower casing engaging with a plurality of channels within the upper casing.

8. The system of claim 6, wherein the upper casing slideably engages the lower casing by means of a plurality of protrusions in the upper casing engaging with a plurality of channels within the lower casing.

9. The system of claim 1, wherein the electrical cable is at least 6 inches in length.

10. An enclosure lighting system for lighting the interior of an enclosure, the enclosure having a first door configured for opening and accessing an interior of the enclosure and a second door configured for opening and accessing the interior of the enclosure, the lighting system comprising:

a first magnetic switch configured to be mounted to a portion of the enclosure that is adjacent to the first door;

a first electrical cable that is electrically coupled to the first magnetic switch;

a first magnet configured to be mounted on the first door so that the first magnet is in close proximity to the first magnetic switch when the first door is closed and wherein the first magnet is not in close proximity to the first magnetic switch when the first door is opened a second magnetic switch configured to be mounted to a portion of the enclosure that is adjacent to the second door;

a second electrical cable electrically coupled to the second magnetic switch; and a second magnet configured to be mounted on the second door so that the second magnet is in close proximity to the second magnetic switch when the second door is closed and wherein the first magnet is not in close proximity to the first magnetic switch when the second door is opened; and a light assembly that is configured to be mounted in the interior of the enclosure spaced apart from the first magnetic switch and spaced apart from the second magnetic switch, the light assembly including:

at least one light emitting diode (LED);

a battery; and a circuit that is electrically coupled to the first electrical cable and is in electrical communication with the first magnetic switch therethrough and that is coupled to the second electrical cable and is in in electrical communication with the second magnetic switch therethrough, wherein the circuit decouples the LED from the battery when both the first magnet is in close proximity to the first magnetic switch and the second magnet is in close proximity to the second magnetic switch, and wherein the circuit couples the LED to the battery, thereby energizing the LED, when either the first magnet is not in close proximity to the first magnetic switch or the second magnet is not in close proximity to the second magnetic switch.

11. The enclosure lighting system of claim 10, further comprising a manual switch that is configured to energize the LEDs when in a first position and to de-energize the LEDs when in a second position.

12. The enclosure lighting system of claim 10, wherein the light assembly includes and upper casing and a lower casing and where the upper casing is configured to be disengaged from the lower casing so as to facilitate replacement of the battery.

13. The enclosure lighting system of claim 12, wherein the upper casing slideably engages the lower casing by means of a plurality of protrusions in the lower casing engaging with a plurality of channels within the upper casing.

14. The enclosure lighting system of claim 13, wherein the upper casing slideably engages the lower casing by means of a plurality of protrusions in the upper casing engaging with a plurality of channels within the lower casing.

15. A cabinet system, comprising:

a cabinet having an inside and a door;

a magnetic switch mounted inside the cabinet and disposed adjacent to the door;

an electrical cable that is at least 6 inches in length and that is electrically coupled to the magnetic switch;

a magnet mounted on the door so that the magnet is in close proximity to the magnetic switch when the door is closed and wherein the magnet is not in close proximity to the magnetic switch when the door is opened; and a light assembly that is configured to be mounted inside the cabinet and spaced apart from the magnetic switch, the light assembly including:

at least one light emitting diode (LED);

a battery; and a circuit that is electrically coupled to the electrical cable in in electrical communication with the magnetic switch therethrough, wherein the circuit decouples the LED from the battery when the magnet is in close proximity to the magnetic switch and wherein the circuit couples the LED to the battery, thereby energizing the LED, when the magnet is not in close proximity to the magnetic switch.

16. The cabinet system of claim 15, further comprising a manual switch that is configured to energize the LEDs when in a first position and to de-energize the LEDs when in a second position.

17. The system of claim 15, wherein the light assembly includes and upper casing and a lower casing and where the upper casing is configured to be disengaged from the lower casing so as to facilitate replacement of the battery.

18. The system of claim 17, wherein the upper casing slideably engages the lower casing by means of a plurality of protrusions in the lower casing engaging with a plurality of channels within the upper casing.

19. The system of claim 17, wherein the upper casing slideably engages the lower casing by means of a plurality of protrusions in the upper casing engaging with a plurality of channels within the lower casing.

* * * * *